US005196030A

United States Patent [19]

Akerblom et al.

[11] Patent Number: 5,196,030

[45] Date of Patent: Mar. 23, 1993

[54] PROCESS WITH NO HEATING FOR TRANSFER PATTERN PRINTING OF A MOIST CELLULOSE, WOOL OR SILK TEXTILE WEB, AND AN APPARATUS AS WELL AS A PATTERN CARRIER WEB FOR USE IN THE PROCESS

[75] Inventors: Inga S. Åkerblom; Claes-Göran Thoren, both of Säffle; Knud V. Rasmussen, Engesvang, all of Sweden; Jørgen Pederson, Herning, Denmark

[73] Assignees: Dansk Transfertryk A/S, Ikast, Denmark; Billerud AB, Säffle, Sweden

[21] Appl. No.: 469,527

[22] PCT Filed: Oct. 4, 1988

[86] PCT No.: PCT/DK88/00162

§ 371 Date: Apr. 30, 1990

§ 102(e) Date: Apr. 30, 1990

[87] PCT Pub. No.: WO89/02950

PCT Pub. Date: Apr. 6, 1989

[30] Foreign Application Priority Data

Oct. 5, 1987 [DK] Denmark ..... 5205/87

[51] Int. Cl.[5] ..... D06P 5/00; B41F 16/02; B41M 1/26

[52] U.S. Cl. ..... 8/467; 8/543; 8/552; 8/558; 8/561; 8/562; 8/917; 8/918

[58] Field of Search ..... 8/467, 543

[56] References Cited

U.S. PATENT DOCUMENTS

| | | | |
|---|---|---|---|
| 1,651,470 | 12/1927 | Sadtler | 8/467 |
| 1,783,606 | 12/1930 | Dreyfus | 8/467 |
| 1,965,257 | 7/1934 | Poschel | 8/470 |
| 1,993,524 | 3/1935 | Poschel | 8/470 |
| 3,666,397 | 5/1972 | Datye et al. | 8/469 |
| 4,027,345 | 6/1977 | Fujisawa et al. | 8/468 |
| 4,033,716 | 7/1977 | Defago et al. | 8/415 |
| 4,057,864 | 11/1977 | Wild | 8/467 |
| 4,155,707 | 5/1979 | Franceschini et al. | 8/467 |
| 4,205,991 | 6/1980 | Becker et al. | 106/22 |

FOREIGN PATENT DOCUMENTS

| | | |
|---|---|---|
| 0001168 | 3/1979 | European Pat. Off. . |
| 0018708 | 11/1980 | European Pat. Off. . |
| 2702300 | 7/1978 | Fed. Rep. of Germany . |
| 3000647 | 7/1981 | Fed. Rep. of Germany . |
| 1227271 | 4/1971 | United Kingdom . |
| 1430831 | 4/1976 | United Kingdom . |
| 1455292 | 11/1976 | United Kingdom . |
| 1480328 | 7/1977 | United Kingdom . |
| 1491799 | 12/1977 | United Kingdom . |
| 2008625 | 6/1979 | United Kingdom . |

*Primary Examiner*—A. Lionel Clingman
*Attorney, Agent, or Firm*—Oliff & Berridge

[57] ABSTRACT

In a process for transfer pattern printing of a moist textile web consisting wholly or predominantly of natural fibers, in particular cotton, and/or artificial fibers on the basis of cellulose, the pattern carrier web is a web of paper or a paper-like material which carries a preprinted pattern of a water soluble or dispersable dye. After wetting of the textile web to a carefully controlled moisture, the textile web is joined with the pattern carrier web and the joined webs are compressed at a suitable pressure so that the pattern can be transferred without using heat. The advantage is that it will be possible to avoid both heating and use of organic solvents. It is also possible to transfer a pattern to a colored textile web since the textile web may be wetted before hand with an aqueous dye solution or dispersion instead of undyed liquid.

20 Claims, 1 Drawing Sheet

FIG. 1
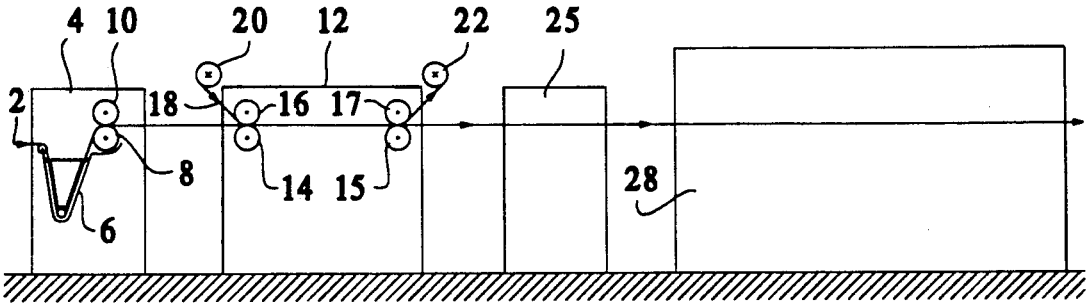
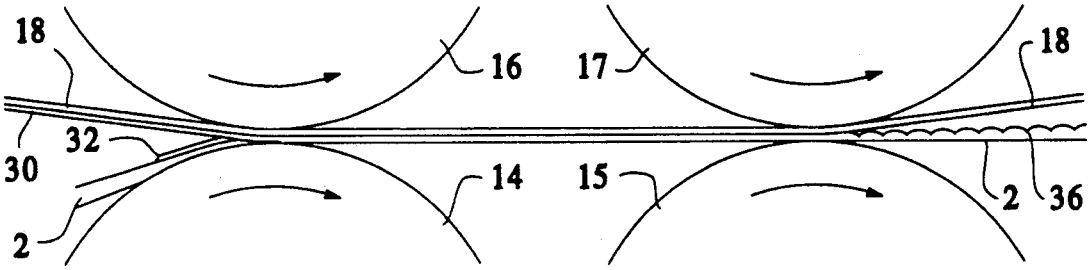
FIG. 2
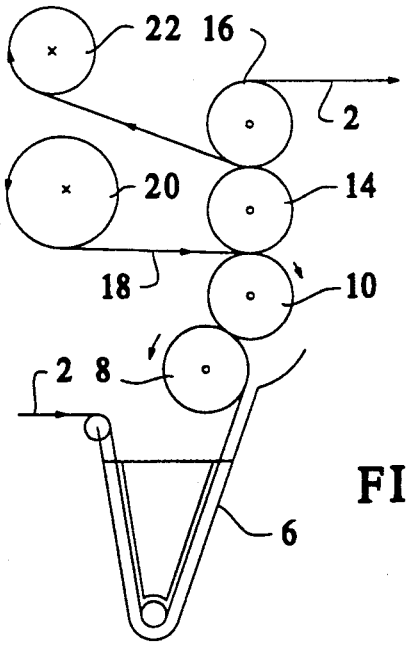
FIG. 3

PROCESS WITH NO HEATING FOR TRANSFER PATTERN PRINTING OF A MOIST CELLULOSE, WOOL OR SILK TEXTILE WEB, AND AN APPARATUS AS WELL AS A PATTERN CARRIER WEB FOR USE IN THE PROCESS

The present invention concerns a process for transfer printing a moist textile web, which wholly or predominantly consists of natural fibres and/or synthetic fibres, preferably on the basis of cellulose. A minor part of the material may be synthetic fibres. By transfer pattern printing is understood continuous transfer of a preprinted pattern from a pattern carrier web to the textile web, the two webs being caused to contact each other continuously in a transfer region which is frequently in the form of one or more pairs of pressure rollers. The invention also concerns an apparatus and a pattern carrier web for use in the process.

Transfer pattern printing is a technique which has been known for a long time, and which has been widely used commercially since the late fifties in particular in the form of sublimation transfer printing for use in printing on textile webs of synthetic fibres, and it involves e.g. the advantage over direct textile printing that the converters can rapidly switch the production to other patterns, so that the supplies of various designs in stock can be limited to the actual demand, while as regards direct textile printing the manufacturer will in practice often have to produce quite large supplies of the individual designs to keep the expenses per printed textile length at a reasonable level.

Another advantage of transfer pattern printing is that it is possible to obtain a quite sharp and finely detailed transfer of the patterns, which have been preprinted by means of suitable dye and with the desired fineness and sharpness on a suitable pattern carrier web.

Transfer pattern printing has been extensively used for these reasons, and the technique is abundantly described in various embodiments in the patent literature. Processes for transfer pattern printing on textile webs of synthetic fibres and/or natural fibres by wet transfer of the pattern from a pattern carrier web to the textile web by brining the webs together, e.g. by passage through rollers, are thus known from the Danish Patent Application (5666/68, which, however, uses a pattern carrier of paper, the fibres of which have the same cellulose structure as cotton, or of silicone treated paper with which the dye has poor or no affinity. The transfer, which takes place at a very small pressure, requires considerable heating of the order of 80° to 300° C. and a typical contact time of between 90 seconds and 5 minutes. In order to reduce the contact time it is necessary to incorporate an organic solvent or white spirit in the dye. However, even with reduced contact time it is a discontinuous process. The same is the case with the Danish Patent Application 1566/69, which requires a contact time of 20 to 220 seconds and a temperature of at least 100° C., typically up to 180° C. The dye is mixed into a water-based paste optionally containing an organic solvent. If the process described is carried out continuously the print becomes unclear and the results consequently unacceptable. A similar process is known from the SE Patent Specification 137 674, which, however, requires using as pattern carrier web a paper web coated with e.g. wheat starch, formaldehyde and a melamine resin applied in separate steps. Statably, the dye has no affinity with this coating. Further, solvent-based inks are used having a high content of white spirit, and the transfer process takes place using high pressure and heating. The aggregate process comprises many components which today would be inconceivable for use in connection with transfer printing, if only for environmental reasons.

Altogether, the known continuous processes for transfer pattern printing are generally performed using elevated temperatures and/or solvent-based inks, and in most cases special demands are made in respect of the nature of the pattern carrier web. Thus, the GB Patent Specification 1 430 831 describes a process which is carried out in a transfer chamber under high-pressure conditions at temperatures above 100° C., thus creating a saturated steam phase which makes possible transfer of the optionally dyed layer from the temporary carrier to the textile web. GB Patent Specification 1 480 328 describes a process for transfer pattern printing on a natural fibre web using increased pressure, the process being feasible with or without heat treatment. Transfer takes place from a paper web to which dyes encapsulated in the binder are applied, and performance of the method without heating requires the presence of a solvent which is added either directly before the transfer or which is present on the pattern carrier web in the form of micro capsules together with the micro capsules containing the dye.

The FR Patent Specifications 1 034 816 and 1 036 510 describe transfer pattern printing on wetted cottons from a paper web to which water-soluble or water-disperse dyes and removable carriers have been applied. According to the former specification a water-soluble dye dispersed in a non-specified fat has been applied to the paper. In the latter specification it is mentioned that the fat may be vaseline, solid paraffin, animal or vegetable oils and fats or mixtures thereof with resin. In both cases the transfer is effected using heat, more particularly 50° to 180° C.

A plurality of other publications concern transfer pattern printing using heating and/or solvent-based inks. These publications include the GB Patent Application 2 008 625, the U.S. Pat. No. 4,155,707, the EP Patent application 0 018 708, the GB Patent Specifications 1 491 799, 1 455 292 and 1 227 271 as well as the SE Published Application 409 125. Additionally, U.S. Pat. No. 4,057,864 describes a continuous wet process in which the transfer is effected at at least 100° C. under increasing pressure exerted by the, in all, 9 pressure rollers running counter to the heated calender-cylinder. According to EP Patent Applications 0 001 168 and 0 032 247 elevated temperatures (80°-120° C.) are also used when carrying out a continuous wet process.

The U.S. Pat. No. 1,651,470 and 1,783,606 mention the possibility of performing the transfer process without heating, but the former works with contact times of 1 minute or more, i.e. a non-continuous procedure, and the latter uses solvents for the dyes, preferably 50% aqueous acetone.

U.S. Pat. No. 1,965,257 and 1,993,524 describe continuous processes with relatively high production velocity and low contact time. Furthermore, ordinary paper can be used as pattern carrier. It is, however, a drawback of these processes that comparatively large amounts of solvents are used, and that transfer must take place at high temperature (approx. 200° F., i.e. approx. 93° C.).

Finally, DE Patent Applications 2 710 158 and 2 702 300 describe wet processes for transfer printing, which also utilize the migration properties of the dyestuffs used by means of the action of heat, typically 100°-120° C.

Some of the above-mentioned publications mention printing on webs of natural fibres, but it is generally admitted that natural fibres, primarily wool and cotton are less suitable for dyeing through transfer of the dyestuff by transfer printing, which, as appears from the foregoing, frequently takes place at elevated temperatures. Tests have long been made with other transfer methods for dyeing natural fibre fabrics, but so far without practically useful results. While, in terms of printing technique, it has been possible to obtain good results, this has been at the expense of the softness or absorbency of the fabric, because the fabric has e.g. been impregnated with a resin which has subsequently been printed using ordinary disperse dyes. Such as impregnation, however, makes the fabric undesirably stiff and poorly absorbing.

It has now surprisingly been found that it is possible to perform transfer pattern printing on a textile web which wholly or predominantly consists of natural fibres, primarily cotton, and/or artificial fibres on the basis of cellulose, without using heat during the transfer proper and solely by using water soluble or water dispersible dyes. Hereby the environmental problems associated with use of organic solvents are avoided, these problems being particularly predominant when also employing elevated temperatures. Furthermore, the process is energy saving as no heating is required for the pattern transfer and as a web of relatively thin paper of a type being economically advantageous to manufacture may be used as pattern carrier.

This is obtained by the process of the invention. According to the present process, the pattern carrier web is thus a web of paper or a paper-like material, more precisely a preferably coated paper with an air permeability of 0.1 to 3000 nm/Pa.s, in particular 0.5 to 1 nm/Pa.s, and a water absorption capacity corresponding to a Cobb-number lower than 50, preferably around 25. The paper is preferably coated with carboxy methyl cellulose (CMC), an alginate or an aqueous dispersion of polyethylene or polyacrylate. The paper web is printed with a pattern of one or more water soluble or dispersible dyestuffs which are mixed with a readily soluble substance. This substance acts as a thickening agent in the ink, as carrier and temporary binder for the dye on the paper and as reaction component during the joining proper of the wetted textile web with the printed paper web. Finally the substance ensure that the two webs are not displaced relative to each other during the transfer of the pattern.

Examples of water soluble dyes include substantive dyes, cationic dyes, acid dyes, chrome complex dyes, and reactive dyes. The dispersible dyes include vat dyes, sulfur dyes, leuco ester vat dyes and pigment dyes.

The actual transfer of the pattern to the textile web, which has been pre-wetted (controlled moisture) takes place in that the textile web in the transfer region is squeezed together with the pattern carrier web under a suitably high linear pressure, the textile web hereby, owing to the high pressure, being compressed over a very short extent to a reduced thickness and then expanded naturally, so that the pattern is effectively sucked from the pattern carrier web to the textile web. This entire process is carried out without using heat, irrespective of the fibre and dye type used.

Examples of fibres which may be subjected to the transfer pattern printing by the process of the invention include natural fibres such as cotton, hemp, jute, flax and other plant fibres as well as wool and silk. Further, cellulose-based artificial fibres may be used, such as viscose fibres. A minor part of the material may be synthetic fibres, e.g. polyester, polyamide or polyacryl.

By way of example, the process of the invention is performed in an apparatus comprising an impregnation mangle and the actual transfer part consisting of one or two pairs of squeezing rollers. The impregnation mangle consists of a liquid trough through which the textile web runs to be wetted and a pad nip pressing out excess liquid under a specific pressure to obtain a controlled moisture content in/on the textile web. The moisture absorbance is dependent upon fabric quality, additions to the aqueous bath, the amount of dye applied to the paper web etc. In all cases the textile web is primarily wetted with water, but to the water may be added e.g. urea which acts as a solvent for the dye and prolongs the penetration phase of the dye, and alkali, which partly has a swelling effect on cellulose fibres and partly a dissolving effect on certain dyestuffs, and the presence of which is necessary for fixation of reactive dyes. Furthermore, the dye bath may be admixed with dye and/or pigments. It has surprisingly been found that it is possible in the subsequent transfer to print the desired pattern on the coloured textile web without the ground colour and the pattern dye running into one another.

After controlled squeezing out of excess liquid to obtain the desired moisture, the moist textile web is passed from the pad mangle to another pair of squeezing rollers together with the pattern carrier web. Just before the joining the latter may be conditioned by passing though a moist haze of preferably clean water, so that the swelling reaction in the applied colour layer and consequently the colour transfer proceed even faster. The two web are passed together through the pair of rollers where they are subjected to a linear pressure, generally of the order of 50 kg/cm. The joined webs may optionally be passed further on through another set of rollers with a corresponding roller pressure. The velocity will normally be 10 to 20 m/min. or more, however not exceeding 50 m/min. Thus, the actual contact time will be approx. 0.1 sec. at a velocity of 10 m/min.

When the pattern has been transferred to the textile web, the dye is fixed, which takes place in a manner known per se in dependence upon the dye used.

As mentioned, the pattern carrier web is printed with a water soluble or dispersible dye mixed with a readily soluble carrier. A suitable material for this purpose is carboxymethyl cellulose (CMC), preferably low viscous CMC, which can optionally be admixed with synthetic thickeners and/or other additives.

The invention will now be explained more fully with reference to the drawing, in which FIG. 1 is an outline of a complete apparatus for performing the process of the invention, FIG. 2 is a section showing in detail the region around two pairs of rollers where the transfer takes place, and FIG. 3 shows a pad mangle for initial wetting and optional ground colouring of the textile web and subsequent joining of it with the pattern carrier web.

In the apparatus shown in FIG. 1, a textile web 2 of natural fibres, optionally mixed with artificial fibres of synthetic fibres, is introduced into a pad mangle 4 in which the web 2 is immersed in a liquid bath, which optionally contains the above-mentioned dye bath. When the textile web passes through a pair of squeezing rollers 8, 10, so much water is squeezed out of it that it contains a carefully defined residual moisture which will typically be 50–80%. The pressure between the rollers 8, 10 is a linear pressure of up to 50 kp/cm. It is decisive that the textile web 2 leaves the pair of rollers 8, 10 with a carefully controlled residual moisture which is determined in each individual case in view of the type of the textile web 2 and also the process conditions.

The web 2 is then joined with the printed pattern carrier web 18 which is unwound from the roll 20, and the joined webs pass through two sets of rollers 14, 16 and 15, 17 which in combination constitute the transfer region 12. The two pairs of rollers each exert a linear pressure of about 50 kp/cm, and the web velocity is normally 10 to 20 m/min, but may be up to 50 m/min.

In the first pair of rollers 14, 16 a certain amount of moisture is squeezed out of the textile web, which thereby moistens the colour layer on the pattern carrier web and thus the carrier for the dye. The carrier is activated (swells) in this manner, so that the dye is pressed into (or penetrates into) the micropores of the fibres very rapidly—within fractions of a second. This effect is enhanced in that the wet fibre is first compressed and then (when leaving the nip) absorbs dye and carrier. This effect is intensified in the second pair of rollers, and then the transfer of dye and binder as been completed. In practice, more than 75% of the dye is transferred. The two webs are separated after having passed the pair of rollers 15, 17, and the paper web is wound onto the take-up roll 22.

The textile web 2 may continue through a post-treatment station 25 where a post-treatment agent in an aqueous solution, in paste form or in the form of a foam may be applied in a manner known per se to improve the fastness (washing fastness, rubbing fastness, etc.) and properties of the printed and optionally primed textile material.

After the post-treatment station 25 the textile web may by way of example be moved into an oven 28 for drying and condensation, where it is first dried to remove the residual moisture and then condensed, i.e. thermo-fixed, in the same process, so that the dye and optional post-treatment agent are caused to react completely, thereby providing the above-mentioned fastness and properties. Driving and condensation may optionally also take place in two processes, i.e. two runs of the same drying furnace. The temperature used depends upon the dye type and the composition of the post-treatment agent as well as the production speed and the length and the heating capacity of the drying oven. The dyestuffs printed on the texture web can also be fixed in a steam phase or in other known ways.

Finally, the textile web may be passed through a washing system (not shown), where any residual chemicals are removed.

FIG. 2 illustrates in more detail the movement of the webs 2 and 18 through the pair of squeezing rollers in the transfer region. A coating 30 of the mentioned dye mixture is shown printed on the carrier web 18, and it is shown how the textile web is compressed between the rollers 14 and 16, so that the coating 30 is then pressed into the surface of the textile web 2. A certain amount of free liquid will occur in front of the pair of rollers int he hatched area 32, in an enlarged scale, said liquid being squeezed out of the wet web 2 by the pair of rollers. This liquid activates the carrier contained in the print coating 30, sot hat the dye contained therein together with the carrier substance will immediately then be pressed into the surface of the textile web 2 while said web is compressed noticeably. After the pair of rollers 15, 17 as described above, and then the two webs 2 and 18 are separated again. The web 2 has now been provided with the transferred print pattern 36.

Finally, FIG. 3 shows another possible embodiment of the process, where the initial adjustment of the moisture of the textile web 2, joining of the textile web 2 with the pattern carrier web 18 and the actual transfer printing take place in the same roller system. When having passed the liquid trough 6, then wetted textile web 2 passes through the nip 8 and 10 whose mutual pressure regulates the moisture. The pattern carrier web 18 is unwound from the roll 20 and is joined with the web 2 between the rollers 10 and 14. Transfer printing takes place in two steps (between the rollers 10 and 14 and between the rollers 14 and 16), and then the webs are separated again. The paper web freed of the pattern is wound onto the roll 22, while the textile 2 with printed pattern proceeds for further treatment.

The invention is illustrated more fully by the following examples.

EXAMPLE 1

According to the invention, transfer printing is performed with pre-bleached cotton linen weighing approx. 200 g/m$^2$. The printing paste used has the following composition:

| | |
|---|---|
| Direct dye, e.g. Indosol Blau SF-GL (C.I. Direct Blue 77) | 20 g |
| Urea | 50 g |
| Sequestering agent | 1 g |
| Sodium carboxymethyl cellulose | 100 g |
| Synthetic thickener | 20 g |
| Demineralized water up to | 1000 g |

The printing paste is applied to a paper web in an arbitrary pattern on a machine of a type which is generally used for printing transfer paper and for direct printing of textiles. The printed paper is dried at approx. 100° C. and may then be stored for 6–24 months depending upon the storage conditions.

Prior to the pattern transfer proper the textile web is wetted, e.g. in a pad mange containing demineralized water, optionally admixed with a dye fixing agent. Where a coloured ground is desired, the liquid may contain approx. 2 g/kg direct dye, e.g. Indosol Rubinole SF-RG (C.I. Direct Red 261); instead, the cationic fixing agent is left out. Excess liquid is squeezed out between a pair of rollers, so that the moisture content of the textile web is 75–80%.

The textile web thus wetted and the pattern carrier web are joined in a first pair of rollers at a linear pressure of 40–45 kp/cm, whereafter the joined web pass through a second nip of rollers at a corresponding linear pressure. Immediately thereafter the paper web (which is not wound up) and the textile web are separated. The latter, now printed with the coloured pattern, is passed on to a drying and fixing oven, in which the dye and the optionally added fixing agent are fixed in one or two runs, either at 170°–180° C. for 30 seconds or for approx. 1 minute at 130° C. Subsequent washing out may be omitted.

The resulting colouring of the cotton fibres is fine and even with sharp contours and good washability similar to what can normally be achieved when dyeing or printing with the same dye.

EXAMPLE 2

Transfer printing is performed on knitwear of cotton (225 g/m$^2$) or a single jersey (160 g/m$^2$). Both qualities must be carefully pre-treated for printing and optionally mercerized and selvage glued. Printing is performed with a two-colour pattern.

| | |
|---|---|
| Printing paste 1: | |
| Reactive dye, e.g. Remazol Rot RB (C.I. Reactive Red 198) | 50 g |
| Sequestering agent | 1–2 g |
| Buffer (to pH 6.0–6.5) | 1–2 g |
| Natural thickener, e.g. Na-CMC | 80 g |
| Sodium alginate | 12 g |
| Emulgator | 0–5 g |
| Demineralized water up to | 1000 g |
| Printing paste 2: | |
| Reactive dye, e.g. Remazol Druckmarineblau RR (C.I. Reactive Blue 122) | 80 g |
| Sequestering agent | 1–2 g |
| Buffer (to pH 6.0–6.5) | 1–2 g |
| Natural thickener, e.g. Na-CMC | 75 g |
| Sodium alginate | 12 g |
| Emulgator | 0–5 g |
| Demineralized water up to | 1000 g |

The printing pastes are applied to a paper web in an arbitrary pattern as stated in example 1. Drying is at 130° C. after which the paper may be stored for 6–18 months.

The textile web is wetted in a pad mangle with demineralized water containing no more than 10 weight-% urea and small amounts of sodium alginate, sodium hydroxide and sodium carbonate or sodium bicarbonate as additives. After wetting, the textile web is pressed to a moisture content of 75%.

The dye transfer from the pattern carrier web to the wetted textile web takes place in the above-mentioned two roller pairs at a linear pressure of 40 and 42 kg/cm, respectively. The velocity is approx. 15 m/min.

The printed textile web is then treated in a thermofixing oven by means of hot air (150° C. for 3 minutes or 175° C. for 1.5 minutes) to react the dye with the cellulose fibres.

After finishing the textile in a manner known per se fine general finenesses are achieved which are quite as good as those obtainable by direct printing. In addition the fabric gets a soft and comfortable finish.

EXAMPLE 3

A two-coloured pattern is to be applied to a knitted viscose fabric (approx. 300 g/m$^2$). The knitted fabric is pre-treated and selvage glued in a manner known per se to ease the passage through the transfer system. The two printing pastes have the following composition:

| | |
|---|---|
| Printing paste 1: | |
| Reactive dye, e.g. Drimarene rot R-4BL (C.I. Reactive Red 147) | 25 g |
| Sequestering agent | 1–2 g |
| Buffer (pH 6.5) | 1–2 g |
| Natual thickener, e.g. Na-CMC | 100 g |
| Sodium alginate | 15 g |
| Emulgator | 0–5 g |
| Demineralized water up to | 1000 g |

-continued

| | |
|---|---|
| Printing paste 2: | |
| Reactie dye, e.g. Drimarene violet R-2RL (C.I. Reactive Violet 33) | 40 g |
| Sequestering agent | 1–2 g |
| Buffer (pH 6.5) | 1–2 g |
| Low viscous Na-CMC | 90 g |
| Sodium alginate | 15 g |
| Emulgator | 0–5 g |
| Demineralized water up to | 1000 g |

The chosen pattern is printed on the paper web as already stated and may then be stored.

The textile web is wetted with the dye path described below in a min-fluid pad mangle to a liquid absorption of 65%:

| | |
|---|---|
| Urea | 50 g |
| Aqueous sodium hydroxide | 4–8 g |
| $Na_2CO_3$ | 2–4 g |
| Na-alginate | 3–5 g |
| Demineralized water up to | 1000 g |

The transfer is effected by passage through two roller pairs as stated above. The linear pressure is 40 and 45 kg/cm, respectively.

The knitted web thus printed is steam fixed in a transfer calender, which instead of the usual carrier felt is provided with a steam-impermeable (optionally teflon-coated) carrier, which when revolving about the heated cylinder together with the still moist textile web, generates a narrow steam chest between cylinder and carrier, whereby the dye penetration and the fixing are prolonged and the fixing yield increases by as much as 20%. The knitted fabric is then finished in a manner known per se.

Altogether, fixing of the dye applied in accordance with the invention may be effected in various ways depending on the dye type printed on the carrier and on the types of machines available. Dependent on the method of fixing chosen, it is possible to vary the additives added to the dye bath. In case of reactive dyes as used in the examples 3 and 4 it is thus possible to 1) moisten the textile web with demineralized water, optionally admixed with urea, and after the dye transfer only to dry the textile web at approx. 110° C.;
2) moisten the textile web and subsequently fix the dye in saturated steam phase, e.g. at 102° C. for 3–8 minutes;
3) leave out NaOH in the dye bath prior to the dye transfer, dry the textile web at approx. 120° C. and subsequently treat the printed textile web with a strongly alkaline, saline liquid and let it rotate for 2–24 hours or
4) leave out NaOH in the dye bath, optionally admix a larger amount of sodium alginate thickener and after the dye transfer submerge the textile web in an alkaline, saline bath (95°–100° C.) The textile is then washed and finished in a manner known per se.

EXAMPLE 4

By and large the same types of reactive dyestuffs as in example 3 and 4 can be used for transfer pattern printing on protein fibres, i.e. wool and silk. However, the composition of the padding liquor in which the textile web is moistened immediately before the transfer of the pattern printed on the carrier, is different from the one used when transferring onto cellulose fibres. This is due to the alkaline sensitivity of the protein fibres, especially wool.

The colour paste for printing on wool and silk may e.g. be composed as in example 3.

When the pattern carrier web has been provided with the coloured pattern, the latter is transferred to the textile web which e.g. is made of wool (scoured and chlorinated) prepared for printing. Before the transfer of the pattern the textile web is moistened with a pad liquor having the following composition:

| | |
|---|---|
| Thickener, e.g. sodium alginate | 10 g |
| Urea | 10–200 g |
| Anti-foaming agent | 1 g |
| Wetting agent | 5–25 g |
| Glacial acetic acid | to pH 4 |
| Demineralized water up to | 1000 g |

After joining the pattern carrier web and the moist textile web together in the transfer mangles under a pressure of approximately 40 kp/cm, the dye is fixed under steam conditions, either in the slightly modified calender as described in example 4 at a temperature of about 100° C. or in a normal steamer of the type used for fixing of direct printed textiles.

The padding liquor for fixing reactive dyes on silk differs only slightly from that for fixing on wool. Again, the composition of the liquor depends on the type of dyestuff used and the particular fixation device.

The textile thus printed is finished in a matter known from direct printing of the same textile. An evenly printed textile with a good level of fastness is obtained.

EXAMPLE 5

According to the invention transfer printing is effected on woven silk having a eight of 0 g/m$^2$, pretreated for printing.

The following colour paste is used for printing the pattern:

| | |
|---|---|
| Acid dye, e.g. Sandolan turkisblau G (C.I. Acid Blue 7) | 65 g |
| Sequestering agent | 1–2 g |
| Anti-foaming agent | 1–2 g |
| Ambergum 1221 (low viscous CMC) | 150 g |
| Sodium alginate | 15 g |
| Water up to | 1000 g |

The approximate viscosity is 3000 cps.

Instead of CMC sodium and alginate use can be made of 50 g polyethylene glycol ester 6000 (HLB value > 15) and optionally 10 g printing oil.

| | | |
|---|---|---|
| Pad liquor: | Thickener, e.g. Sodium alginate | 10 g |
| | Urea | 50–100 g |
| | Anti-foaming agent | 1–2 g |
| | Wetting agent | 1–2 g |
| | Acetic acid | to pH 4,5 |
| | Demineralized water up to | 1000 g |

Instead of thermofixing silk textiles they can advantageously be steam fixated, as by this means the best possible dyestuff fixation and the least possible fiber damage are obtained.

The pattern carrier web printed with the above colour paste can also be used for printing wool, optionally mixed with silk or polyamide, and textiles exclusively consisting of polyamide which is a synthetic fibre. Here too it is recommended to steam fixate the printed textile.

The textile thus printed is finished in a matter known from direct printing of the same fibre type. The level of fastness is fully comparable to that of direct printed textiles.

EXAMPLE 6

For printing on a cotton tricot (180 g/m$^2$), prepared for printing, the following printing paste is used:

| | |
|---|---|
| Direct dye, e.g. Indosol violett SF-B 2207 (C.I. Direct Violet 66) | 15 g |
| Urea | 50 g |
| Sequestering agent | 1–2 g |
| Anti-foaming agent | 1–2 g |
| Thickener (starch ether with a high degree of etherification, a relatively low viscosity and a high remoisterizing ability) | 150 g |
| Demineralized water up to | 1000 g |

The approximate viscosity is 3000 cps.

This colour paste is printed as a pattern on a pattern carrier web. Moistening of the textile web, transfer of the pattern from the carrier web to the textile web and finishing of the textile web are effected as described in example 1.

EXAMPLE 7

A woven cotton having a weight of 250 g/m$^2$, pretreated for printing and mercerized, is transfer printed by the method according to the invention.

The following colour paste is used for printing the pattern on the paper web:

| | |
|---|---|
| Reactive dye the dichloroquinoxaline type | 50 g |
| Buffer pH 6.0–6.5 | 1–2 g |
| Sequestering agent | 1–2 g |
| Anti-foaming agent | 1–2 g |
| Printing additive (oil) | about 10 g |
| Polyethylene glycol ester 6000 (e.g. Emulgator DMR with an HLB value of 18) | 50 g |
| Demineralized water up to | 1000 g |

The approximate viscosity is 3000 cps.

After moistening of the textile web the pattern is transferred thereto as described in example 3. The finish treatment is effected as described in example 3.

We claim:

1. A continuous process for transfer pattern printing on a moist textile web comprising the steps of:

pre-printing a pattern with a reactive dye admixed with a readily soluble thickener having temporary binder effect on a pattern carrier web of an absorbent material;

wetting a textile web with water optionally containing a reactive dye dissolved or dispersed in said water, the textile web comprising predominantly cellulose or protein fibers and from 0% to 30% synthetic fibers;

moving the wetted textile web to a region where the transfer of the pre-printed pattern from the pattern carrier web to the wetted textile web takes place;

continuously transferring the pattern from the pattern carrier web to the wetted textile web without heat by compression of the two webs between one or more pairs of rollers under pressure, the textile web being subjected between the rollers to compression to a reduced thickness followed by a natural expansion such that the pattern is effectively absorbed from the pattern carrier web to the textile web.

2. A process according to claim 1, wherein the pressure between the rollers is a linear pressure from 10–50 kp/cm.

3. A process according to claim 1, wherein in the step of wetting prior to transfer pattern printing, the textile web is ground colored with an aqueous reactive dye solution.

4. The process according to claim 1, wherein the pattern carrier web comprises absorbent paper.

5. The process according to claim 4, wherein the paper is coated with an aqueous dispersion of polyethylene or polyacrylate, an alginate or carboxy methyl cellulose.

6. The process according to claim 4, wherein the paper has an air permeability of 0.1 to 3000 nm/Pa.s as measured according to standard test method SCAN P 26:78.

7. The process according to claim 6, wherein the paper has an air permeability of 0.5 to 1 nm/Pa.s as measured according to standard test method SCAN P 26:78.

8. The process according to claim 4, wherein the paper has a water absorption corresponding to a Cobb-number below 50 as measured according to standard test method ISO 535, 1976.

9. The process according to claim 8, wherein the paper has a water absorption corresponding to a Cobb-number of about 25 as measured according to standard test method ISO 535, 1976.

10. The process according to claim 5, wherein the paper is coated with at least one member selected from the group consisting of carboxymethyl cellulose, alginate and an aqueous dispersion of polyethylene or polyacrylate.

11. The process according to claim 1, wherein said readily soluble thickener is selected from the group consisting of carboxymethyl cellulose, polysubstituted starch ethers, polyethylene glycol esters and polymers having thickening effect with hydrophile-lipophile balance values above 15.

12. The process according to claim 1, wherein the two webs pass through the rollers at a velocity of 5 to 50 m/min.

13. The process according to claim 1, wherein the pattern is transferred in the absence of volatile solvents.

14. A pattern carrier web comprising absorbing paper which has been printed with a dye pattern, the dye pattern comprising a reactive dye admixed with a readily soluble thickener, said thickener being selected from the group consisting of carboxymethyl cellulose, polysubstituted starch ethers, polyethylene glycol esters and polymers having hdyrophile-lipophile balance values above 15.

15. The pattern web according to claim 14, wherein the paper is coated with an aqueous dispersion of polyethylene or polyacrylate, an alginate or carboxy methyl cellulose.

16. A pattern carrier web according to claim 14, wherein the paper has an air permeability of 0.1 to 3000 nm/Pa.s as measured according to standard test method SCAN P 26:78.

17. A pattern carrier web according to claim 16, wherein the paper has an air permeability of 0.5 to 1 nm/Pa.s as measured according to standard test method SCAN P 26:78.

18. A pattern carrier web according to claim 16, wherein the paper has a water absorption corresponding to a Cobb-number below 50 as measured according to standard test method ISO 535, 1976.

19. A pattern carrier web according to claim 18, wherein the paper has a water absorption corresponding to a Cobb-number of about 25 as measured according to standard test method ISO 535, 1976.

20. The patter carrier web according to claim 15, wherein the paper is coated with at least one member selected from the group consisting of carboxymethyl cellulose, alginate and an aqueous dispersion of polyethylene or polyacrylate.

* * * * *